United States Patent [19]

Boehmke

[11] 4,295,859

[45] Oct. 20, 1981

[54] FUELS AND HEATING OILS, A PROCESS FOR THEIR PREPARATION AND THEIR USE

[75] Inventor: Günther Boehmke, Leverkusen, Fed. Rep. of Germany

[73] Assignee: Bayer Aktiengesellschaft, Leverkusen, Fed. Rep. of Germany

[21] Appl. No.: 99,124

[22] Filed: Nov. 30, 1979

[30] Foreign Application Priority Data

Dec. 16, 1978 [DE] Fed. Rep. of Germany ..... 2854437

[51] Int. Cl.[3] ..... C10L 1/18

[52] U.S. Cl. ..... 44/51; 44/56; 44/77

[58] Field of Search ..... 44/51, 56, 77

[56] References Cited

U.S. PATENT DOCUMENTS

| | | | |
|---|---|---|---|
| 2,805,135 | 9/1957 | Bell et al. | 44/71 |
| 3,032,971 | 5/1962 | Shottox | 44/77 |
| 4,182,614 | 1/1980 | Moriyama et al. | 44/51 |

*Primary Examiner*—Jacqueline V. Howard

*Attorney, Agent, or Firm*—Sprung, Felfe, Horn, Lynch & Kramer

[57] ABSTRACT

Fuels and heating oils containing hydrocarbons, water and emulsifiers are disclosed wherein the emulsifier is a non-ionic emulsifier and the non-ionic emulsifier is one which contains less than 1,000 ppm of salt constituents and less than 1 percent by weight of polyalkylene glycol ether constituents.

6 Claims, No Drawings

FUELS AND HEATING OILS, A PROCESS FOR THEIR PREPARATION AND THEIR USE

The invention relates to fuels for combustion engines such as gasoline engines and diesel engines as well as rotary piston engines and turbines, or heating oils for oil-burning equipment, which contain emulsifiers or emulsifier mixtures and water and, if appropriate, alcohols, in the fuels or heating oils customary for the particular units. The invention furthermore relates to a process for their preparation and to their use.

It has been known for a long time that the combustion of fuels, such as is utilized for example, in petrol engines, diesel engines and Wankel engines, or of heating oils is improved by water. It has been proposed both to inject water into the combustion chamber and to introduce water into the combustion chamber in the form of an emulsion with the fuel or the heating oil. The latter proposal has been described in German Offenlegungsschrift Nos. 1,545,509 and 2,633,462.

On separation of the emulsions, in general two layers are formed which consist of a water-in-oil emulsion and an oil-in-water emulsion. However, the latter contains the predominant proportion of the water and in addition, the viscosity of this layer, in particular, depends on the temperature. In general, it is no longer able to pass through the filters and jets at below 5° C.

It has now been found, surprisingly, that the tendency of emulsions, in particular of water-in-oil emulsions, to separate can be avoided if the impurities, which mainly consist of polyalkylene glycol ethers and salts originating from the catalyst, are removed from the non-ionic emulsifiers. This is particularly effective in the case of low viscosity water-in-oil emulsions, whilst the phenomenon is, of course, scarcely of significance in the case of emulsions of high viscosity (for example lotions and creams).

Accordingly, fuels or heating oils containing water, a non-ionic emulsifier and, if appropriate, an alcohol have been found, which are characterized in that the non-ionic emulsifier employed contains less than 1,000 ppm of salt constituents and less than 1% by weight of polyalkylene glycol ethers.

A process has also been found for the preparation of fuels or heating oils containing water, a non-ionic emulsifier and, if appropriate, an alcohol, which is characterized in that a non-ionic emulsifier which contains less than 1,000 ppm of salt constituents and less than 1% by weight of polyalkylene glycol ethers is employed for the preparation, which is carried out in a manner which is known per se.

Examples of non-ionic emulsifiers which may be mentioned are emulsifiers of the alkyl ether, alkanecarboxylate, alkanecarboxamide or alkylamine type. Specific examples which may be mentioned are the oxyethylation products of alcohols with 8–22 C atoms, of alkyl 1,2-glycols, of fatty acids, fatty acid amides, fatty amines, synthetic fatty acids, naphthenic acids or resin acids, and furthermore of alkylphenols or of aralkylphenols obtained with 1–30 mols of ethylene oxide and/or propylene oxide, or of esterification products of fatty acids and glycerol, or of polyalcohols.

The non-ionic emulsifiers are obtained, for example, by reacting 2–50 mols of ethylene oxide or ethylene oxide and propylene oxide with (a) an alcohol with 8–22 C atoms, which can be straight-chain or branched and saturated or unsaturated, with (b) an alkyl 1,2-glycol with 10–22 C atoms, with (c) a fatty acid with 10–22 C atoms, which can be saturated or unsaturated and straight-chain or branched, with (d) resin acids or naphthenic acids, with (e) an alkylphenol, such as nonylphenol or dodecylphenol, or aralkylphenols, or with (f) fats, such as castor oil, coconut oil, palm oil, tallow fat or lard, sunflower oil, safflower oil or olive oil.

Detailed descriptions of these non-ionic emulsifiers to be employed according to the invention can be found in "Grenzflächenaktive Äthylenoxid-Addukte. Ihre Herstellung, Eigenschaften, Anwendung und Analyse" ("Surface-active Ethylene Oxide Adducts, their Preparation, Properties, Use and Analysis") by N. Schönfeldt, Stuttgart 1976, and in "Nonionic Surfactants" by M. J. Schick, M. Dekker, New York, 1976.

However, a characteristic of the invention is that only purified non-ionic emulsifiers which are free from polyglycol ethers and catalyst salts, which in general can form during the preparation process by side reactions with impurities or moisture, are used. The polyglycol ethers which are formed by transesterification during the oxyethylation of the fatty acids or triglycerides (naturally occurring fats), must likewise be removed, since for probability reasons alone, they are contained in relatively large amounts (5–18%). All the processes with which the expert is familiar are suitable purification methods for removing the constituents mentioned.

The property of the non-ionic emulsifiers of separating out of an aqueous solution on heating can be utilized for the purification. If a mixture of water with an emulsifier in the ratio 1:1 is heated to 90°–100° C., a water-containing, approximately 65% strength emulsifier layer separates out at the bottom, and the upper aqueous layer which separates out contains the polyglycol ethers and the catalyst salts. The alkalinity arising from the oxyethylation catalyst (KOH or NaOH) is advantageously removed by neutralizing with sulphuric acid or acetic acid before the separation. This procedure approximately corresponds to that in German Patent Specification 828,839. After drying, the emulsifiers contain less than 0.01% of salts (from a previous 0.3–0.5%), and preferably less than 0.5% of polyethylene glycol ether (from a previous 3–8%).

Requiring still less effort, but equally effective, is a purification via an organic water-immiscible solvent, for example toluene, in which the emulsifier and solvent are mixed in an approximate ratio of 1:1. 5–10% by weight of water and, if necessary, an acid (such as, for example, sulphuric acid or acetic acid) to neutralize basic constituents, are stirred into the solution. When the mixture is left to stand or separated in a centrifuge, an aqueous layer forms at the bottom. This contains the polyglycol ether and the salts. Since this solution is approximately 50–60% strength, it can easily be removed by combustion. The toluene layer can be freed completely of water and toluene. However, for the intended use according to the invention, one can dry the toluene/emulsifier solution by distilling off the water azetropically and employ this solution. The non-ionic emulsifiers to be employed according to the invention can be purified, for example, by the process of a copending application having the title "Non-ionic emulsifiers and a process for their purification" (German Patent Application P 28 54 541.7; inventor: Guenther Boehmke). The disclosure of such application is hereby specifically incorporated herein by reference.

The fuels or heating oils according to the invention contain, for example, 55–97% of a hydrocarbon mixture such as is generally employed as gasoline or as diesel oil or as heating oil, 0.5–'% of water (free from anionic salts which form residues), 0–30% of monohydric straight-chain or branched $C_1$–$C_8$-alcohols, 0.5–6% of a non-ionic emulsifier which has been purified by removing the polyglycol ether constituents and salt constituents, and 0.1–4.8% of a fatty acid monoglyceride, of an adduct of 1–3 mols of ethylene oxide and 1 mol of a fatty acid amide or of a mixture thereof, or of a partial ester of a fatty acid and a polyalcohol. (All the % data given here are percent by weight.)

A fuel composition containing 0.5–3% by weight of a purified non-ionic emulsifier and 0.1–2.5% by weight of a fatty acid monoglyceride, of an adduct of 1–3 mols of ethylene oxide and 1 mol of a fatty acid amide or of a mixture thereof, or of a partial ester of a fatty acid and polyglycols is preferred.

The hydrocarbons contained in the fuels according to the invention are in general the mixtures customary for this purpose, such as those characterised by their physical data in DIN Specification No. 51 600 or in United States Federal Specification VV-M-561 a-2 of Oct. 30, 1954. These are aliphatic hydrocarbons from gaseous, dissolved butane up to $C_{20}$-hydrocarbons (as the residual fraction of diesel oil), for example cycloaliphatic, olefinic and/or aromatic hydrocarbons, naturally occurring naphthene-based hydrocarbons or refined technical grade hydrocarbons. The compositions according to the invention preferably contain no lead alkyls and similar toxic additives.

In general, the heating oils according to the invention contain, as the hydrocarbon constituent, the compositions commerically available under the description light or medium-heavy heating oil.

Lower alcohols are used in the fuels and heating oils according to the invention to increase the spontaneity of emulsion, the stability in the cold and to minimize the dependence of the emulsification of the water on the temperature. In general, spontaneity can be achieved with the aid of mixed emulsifiers of various ionic character. Since water-in-oil emulsions are used in a motor fuel for corrosion reasons and because only non-ionic emulsifiers can be used with any certainty, it must be described as exceptionally surprising that spontaneous water-in-oil emulsions are obtained with the emulsifiers according to the invention. As a result, the fuels and heating oils according to the invention have a considerably improved stability in the cold, which not only consists in the prevention of the formation of ice crystals but also is to be attributed to the fact that gel structures which can cause an uncontrolled increase in viscosity do not arise.

Alcohols which may be mentioned are straight-chain or branched aliphatic alcohols and cycloaliphatic alcohols, such as methanol, ethanol, propanol, isopropanol, butanol, iso-butanol, tert.-butanol, amyl alcohol, iso-amyl alcohol, hexyl alcohol, 1,3-diemthylbutanol, cyclohexanol, methylcyclohexanol, octanol and 2-ethyl-hexanol. Mixtures of these alcohols can also readily be used. Alcohols which are readily accessible industrially are preferably employed, for example methanol, ethanol, isopropanol, iso-butanol and 2-ethyl-hexanol.

The fuel emulsion or heating oil emulsion according to the invention is prepared in a manner which is known per se, by stirring the water into a solution of the purified emulsifier in the hydrocarbon, which contains alcohol if appropriate, during which, preferably, no machines supplying further dispersion energy are employed. In a modification of this procedure, the emulsifier, and if appropriate also the alcohol, can be dispersed in the hydrocarbon and/or water.

The fatty acid monoglycerides are used both to lower the viscosity of the system and to stabilize the emulsion. Because of the preparation process, these monoglycerides frequently also contain appreciable amounts of glycerol (polyglycerol). These constituents must also be removed by purification. Accordingly, glycerol and polyglycerol and likewise to be regarded as polyalkylene glycol ethers which must be removed from the emulsifier to be employed according to the invention down to a residual content of less than 1% by weight.

The fatty acid amide-ethylene oxide adducts can be obtained by direct amidation or by splitting esters with ethanolamine. A particularly readily accessible mixture of monoethanolamide and a monoglyceride is obtained by reacting 1 mol of a triglyceride with 2 mols of ethanolamine at 160°–180° C. for 3–5 hours.

The monoethanolamides are used for lowering the viscosity, for stabilizing the emulsion and also for protection against corrosion and, in connection with the emulsifiers, as a carburettor cleaning agent (detergent).

Fine dispersion of the water in the fuel or in the heating oil is considerably improved in the fuels and heating oils according to the invention by using the emulsifiers in the purified form. With the aid of the fuels and heating oils according to the invention, it could be discovered, surprisingly, that the quality of the fine dispersion of the water for manipulating the fuel or heating oil and for the technical course of its storage and conveyance to the combustion chamber is decisive for the efficiency with which the water is used.

The new fuels are suitable for lowering the consumption of energy in present-day motor vehicles, for reducing the exhaust of harmful substances, for removing the danger arising from lead tetraalkyls and scavengers (dichloroethane and dibromoethane, compare Chemiker-Zeitung 97 (1973), No. 9, page 463) and for having an anti-corrosion action without thereby demanding a greater industrial effort on modifications to the vehicles. It may only become necessary to effect slight corrections to the float or to the jets of the carburettor to adapt to the somewhat higher density.

Another advantage of the fuels, according to the invention, containing emulsifiers and water and, if appropriate, alcohols is that their electrostatic charge is greatly reduced, so that a considerable danger when handling fuels is reduced (compare Haase, Statische Elektrizität als Gefahr (Static Electricity as a Danger), Verlag Chemie, Weinheim/Bergstrasse 1968, especially pages 69, 96–99, 114 and 115). The electrostatic charge of the fuels according to the invention is so low that dangerous discharges can no longer occur. At 20° C., the normal-grade gasoline used has specific volume resistivity values of about $1.10^{12}\Omega$.cm, and in contrast the fuel according to the invention in general has a specific volume resistivity of less than $1.10^{10}\Omega$.cm, for example of $1.10^7$ to $1.10^{10}\Omega$.cm. The specific volume resistivity of the fuels according to the invention is preferably $1.10^8$ to $9.10^9\Omega$.cm. At values of less than $10^{10}\Omega$.cm, there is no longer a danger of electrostatic charging during filling up, transferring and emptying.

On combustion, the heating oil emulsions according to the invention bring about better transfer of the heat of combustion to the heating agent system and less emission of solids through the chimney.

EXAMPLE 1

A fuel of the following composition was used to drive an Opel Kadett (1.1 l cylinder capacity, 45 horsepower): 72% of commercially available normal-grade petrol, 1.25% of Linevol 91+3 mols of ethylene oxide (a synthetic alcohol with small proportions of branched chains with 9, 10 and 11 C atoms), 1.25% of Linevol 91+7 mols of ethylene oxide (both emulsifiers had first been freed from the concomitant substances, such as polyglycols and catalyst salts, by washing with water) and 0.5% of coconut oil acid amide +1 mol of ethylene oxide are mixed with one another and 25% of water (distilled or completely desalinated) is allowed to run in, whilst stirring, and after the last addition the mixture is further stirred for 10–20 seconds (that is to say until every part of the contents of the vessel has been stirred up). A milky, stable emulsion which had a viscosity of 2,7 m PA s is obtained. The specific, electric volume resistivity was $5.10^9\Omega$.cm.

The car was tested on a roller test stand at 100 km/hour for 15 minutes. The resistance on the rollers was adjusted to 20 kg. The float in the carburettor was adjusted to 0.8, corresponding to the fuel density of 0.797 at 20° C. Measurement of the consumption during these experiments gave, calculated as liters per 100 km, a consumption of 9.4 l of this fuel, containing 72% of gasoline, per 100 km. Using gasoline in the same vehible and under these test conditions, an extra consumption of about 1/ 1/100 km was recorded.

When the fuel was prepared from non-purified emulsifiers which contained, in the impure form, fatty alcohol +3 mols of ethylene oxide, 2.5% of polyglycol ether and 0.23% of ash, or fatty alcohol +7 mols of ethylene oxide, 4% polyglycol ether and 0.23% of ash, two layers which consisted of a water-in-oil emulsion and an oil-in-water emulsion were formed shortly after emulsifcation. The layers could indeed be emulsified again by mechanical means, but no longer formed an emulsion which was stable for a relatively long period.

The emulsifiers used were purified by the following methods: 100 g of the synthetic $C_{9-11}$-alcohol which had been reacted with 7 mols of ethylene oxide are mixed with 100 g of water and the alkali originating from the oxyethylation catalyst (about 0.2%) was neutralized with sulphuric acid. The neutral solution is heated to 98°–100° C. After one hour, the two layers which formed were separated. The aqueous layer containing potassium sulphate (about 0.5 g) and the polyglycol ethers (about 4 g) forms the upper layer, and the viscous, approximately 60% strength emulsifier solution can be drained off below. About 95 g of the purified emulsifier can be obtained by distilling off the water and drying the residue in vacuo.

The content of ash still in the emulsifier is only 0.006% and that of polyglycol ether is less than 0.2%.

EXAMPLE 2

The fuel according to Example 1 was stirred thoroughly with 5% of methanol (relative to the total amount). The emulsion remained stable, but was now protected against temperatures of below 0° C. and could be employed as described above.

EXAMPLE 3

2.25% of Linevol 91+7 mols of ethylene oxide (washed by the process using the toluene solution) and 0.75% of coconut oil acid amide +1 mol of ethylene oxide are added to a commercially available normal-grade gasoline. 25% of water which contains no mineral constituents is allowed to run in, whilst stirring. After 5% of water has run in, the emulsion is still clear and transparent and then, as the amount of water increases, changes into a milky, stable emulsion which can be employed as in Example 1.

The emulsifier is purified by the following process: 100 g of the synthetic $C_{9-11}$-alcohol which has been reacted with 7 mols of ethylene oxide are mixed with 10 g of water and the alkali from the oxyethylation catalyst is neutralized with acetic acid. The solution is stirred with 100 ccs of toluene. After 1–3 hours, 7.5 g of an aqueous layer which contains 4 g of polyglycol ether and about 0.5 g of potassium acetate separate out of the turbid mixture. After distilling off the toluene, which simultaneously drives off the water, about 95 g of the purified emulsifier are obtained.

EXAMPLE 4

A lead-free normal-grade petrol is taken and the emulsifiers according to Example 3 are used, that is to say 92% of lead-free normal-grade petrol, 2.0% of the purified emulsifier consisting of Linevol 91+7 moles of ethylene oxide and 0.65% of coconut oil acid amide +1 mol of ethylene oxide, and 5.3% of water is stirred in at a rate such that it is taken up without turbidity. The transparent, slightly opalescent fuel is suitable as a lead-free fuel for driving a 55 horsepower FIAT 128 vehicle with a 1,160 ccs engine (compression: 1:9.2) which was usually driven on super-grade fuel. On starting up and accelerating from a low speed, no knocking could be observed, as was otherwise customary in the case of normal-grade petrol.

EXAMPLE 5

The following fuel was prepared from a lead-free normal-grade petrol using the emulsifiers below: 72% of lead-free normal-grade petrol, 2.2% of oleic acid amide +7 mols of ethylene oxide and 0.8% of Linevol 91+3 mols of ethylene oxide (both purified from by-products) are mixed and 25% of water are emulsified in, whilst stirring. A milky fuel which can be employed as in Example 4 and in which aqueous sediments do not tend to separate out is obtained.

In the case of the oxyethylated amides in the purified form it is even more noticeable than in the case of the oxyethylated alcohol that the turbidity point, which is important for ensuring reproducibility, of the 1% strength aqueous solution cannot be determined when the water which is used in the fuel is utilized (<5 ppm of mineral salts, or a conductivity of $<4\mu$ Siemens). The addition of 200 ppm of sodium chloride is to be recommended for the determination.

EXAMPLE 6

A lead-free regular-grade gasoline is used to prepare a fuel of the following composition: 70.5% of petrol, 1.1% of Linevol 91+3 mols of ethylene oxide, 1.1% of Linevol 91+7 mols of ethylene oxide, 0.8% of coconut oil acid amide +1 mol of ethylene oxide (the emulsifiers are employed in the purified form) and 1.5% of isobutanol are mixed and 25% of water is slowly mixed in at 10°–13° C. A fuel which has a viscosity of 1,3 m PA s and is only insignificantly changed even at temperatures down to −10° C. is obtained.

EXAMPLE 7

For better manipulation of the emulsifiers, it is also possible to mix 3 parts of the emulsifier of the composition mentioned in Example 6 with 3 parts of petrol and 3 parts of water to give a clear solution. 70.5% of petrol, 1.5% of isobutanol and 9% of the above-mentioned mixture are then metered together and 22% of water can be admixed, in a stream, to this mixture in a suitable mixing chamber. The water is thereby emulsified in the mixing chamber by turbulence.

The tank of a 1.7 l Opel Rekord in the carburettor of which an air funnel which had been reduced from 28 to 26 had been inserted was filled up with the fuel obtained in this manner. When driven in urban traffic, the vehicle behaved normally and exhibited no noticeable changes. The CO exhaust gas values of this car, which has been in use for over 3 years, were 1% lower than the values measured before using super-grade petrol.

EXAMPLE 8

A commercially available normal-grade petrol was formulated to a fuel of the following composition, using the following emulsifiers and solvents: 1.2% of Linevol 91+3 mols of ethylene oxide, 1.2% of Linevol 91+7 mols of ethylene oxide, 0.6% of coconut oil acid amide +1 mol of ethylene oxide (the emulsifiers were in the purified form), 5% of a solvent mixture (methanol: isobutanol:2-ethylhexanol=84:10:6) and 67% of petrol were mixed and the mixture was stirred slowly was 25% of water to give a low-viscosity fuel which could be employed as in Example 7 but had even more favourable viscosity properties at −10° C.

EXAMPLE 9

The following fuel containing a commercially available diesel oil was formulated for use in a motor vehicle with a diesel engine: in 70.1 parts of diesel oil, 2.6 parts of nonylphenol +6 mols of ethylene oxide (which dissolved in the diesel oil, whilst the impure product remained turbid) and 0.3 part of coconut oil acid amide +1 mol of ethylene oxide were dissolved, and 27 parts of water were emulsified into the solution.

Excellent driving results could be achieved with this fuel. The fatty acid amide derivative leads, inter alia, to good rust protection in the tank and lines.

EXAMPLE 10

To obtain a petrol emulsion, 0.9% of a non-ionic emulsifier, that is to say cetyl stearyl alcohol +12 mols of ethylene oxide, and 2.1% of ricinoleic acid monoglyceride are dissolved in 72% of gasoline. 25% of water is emulsified into the solution. When the emulsifier was employed in the unwashed state, a 0.001 cm thick layer had a light absorption of 0.44 ($\lambda=700$ m$\mu$) after 2 hours, and after 24 hours, a milky layer which was rich in water separated out at the bottom and, after stirring, the mixture had about the same unfavourable absorption values as that above.

The gasoline emulsion using a washed emulsifier had an absorption of 0.30 and, after 24 hours, formed a petrol-rich surface layer of only a few mm. After stirring, an emulsion with the same absorption was obtained.

The following mixture can also be used to obtain the effect of the purification on the stability.

10% of the same non-ionic emulsifier consisting of cetyl stearyl alcohol +12 mols of ethylene oxide was dissolved in diesel oil and 0.5$^3$ cm of water was added for clarification.

The unwashed emulsifier is persistently turbid whilst the washed emulsifier gives a clear solution.

When a further 4.5 cm$^3$ of water are emulsified, the unwashed emulsifier leads to a gelatinous, turbid, unstable emulsion. In this system, the washed emulsifier forms a stable, clear solution which possesses structural viscosity and exhibits the Tyndall effect and can be mixed with the remaining components to produce the fuel.

EXAMPLE 11

A fuel formulation is obtained from 72% of normal-grade petrol, 0.9% of coconut oil acid monoethanolamide (technical grade mixture prepared by reacting 1 mol of coconut oil with 2 mols of ethanolamine at 160°–170° C. for about 5 hours) and 2.1% of a purified, non-ionic emulsifier consisting of abietic acid +12 mols of ethylene oxide, and 25% of water, which is emulsified in. A mobile, stable fuel is obtained.

If, on the other hand, emulsification is carried out with the aid of an unwashed emulsifier which contains about 10–12% of polyglycol ethers originating from the preparation and from trans-esterification reactions, an emulsion in which about 20% of a milky layer containing a large amount of water is already deposited at the bottom after 15 minutes is obtained. If this layer first runs out of the vehicle tank and enters the carcarburettor, ignition no longer takes place.

EXAMPLE 12

A fuel formulation containing 79% of lead-free normal-grade petrol, 1.8% of oleic acid amide +7 mols of ethylene oxide and 1.2% of ricinoleic acid monoglyceride (Rilanit GRMO from Messrs. Henkel), in which 4% of the impurities had been removed from the ethylene oxide adduct and about 3.5% of glycerol had been removed from the monoglyceride by the purification described, was prepared by emulsifying in a mixture of 4% of methanol and 15% of water. Even after 8 days, this fuel had no sediment and remained mobile on cooling to −5° C. In contrast, when the impure emulsifiers were used, a second emulsion phase which became highly viscous even at temperatures of 2°–5° C. was already observed after a few hours. These constituents (about 20–25%) pass through neither the fuel filter nor the carburettor system.

EXAMPLE 13

The same raw materials as in Example 12 were employed in the following amounts: 67% of lead-free normal-grade petrol, 1.8% of the ethylene oxide adduct and 1.2% of the monoglyceride, and 5% of methanol and 25% of water mixed in by emulsifying. In contrast to this stable emulsion, when unwashed emulsifiers are used, a streaky, opalescent emulsion which separates into two emulsion phases in a few hours, the lower phase of which contains the predominant amount of the water employed, is obtained.

EXAMPLE 14

A stable fuel which still retained its low viscosity even at −5° C., so that the vehicle suffers no trouble with regard to handling was prepared from 79% of regular-grade gasoline, 2.1% of oleic acid monoethanolamide +7 mols of ethylene oxide and 0.9% of oleic acid monoglyceride by emulsifying in 15% of water and 3% of methanol.

EXAMPLE 15

A commercially available, light heating oil with the characterization EL was mixed with an emulsifier, consisting of 1 mol of nonylphenol and 5.6 mols of ethylene oxide, in amounts of 2.6 parts of this emulsifier in the purified form and 77 parts of heating oil EL, and 20 parts of water were emulsified in. Immediately thereafter, 0.4 part of a reaction product of 1 mol of tallow and 2 mols of ethanolamine (160° C. for 5 hours) was also added. During this addition, a lowering of the emulsion viscosity is also observed, and in addition a rust protection effect is achieved.

On measuring the soot spot number in accordance with the First Order concerning implementation of the 1st BIm SCHV (Bundes-Immissionsschutzgesetz-Verordnung) 2a, 4, a soot spot number of 1 was measured with the heating oil and a soot spot number of 0 was measured with the emulsion. Transfer of the heat of combustion was particularly favourable.

What is claimed is:

1. A fuel for a combustion engine or heating oil comprising a hydrocarbon, water and a non-ionic emulsifier, said non-ionic emulsifier containing less than 1,000 ppm of salt constituents and less than 1 percent by weight of polyalkylene glycol ethers.

2. A fuel according to claim 1 containing 55 to 97 percent by weight of a hydrocarbon mixture of the type employed in gasoline or diesel oil, 0.5 to 40 percent by weight of water free of anionic salts which form residues, 0 to 30 percent by weight of a monohydric straight-chain or branched $C_1$ to $C_8$-alcohol, 0.5 to 6 percent by weight of a non-ionic emulsifier which has been purified by removing the polyglycol ether constituents and salt constituents, and 0.1 to 4.8 percent by weight of a fatty acid monogylceride, of an adduct of 1–3 mols of ethylene oxide and 1 mol of a fatty acid amide or a mixture thereof, or of a partial ester of a fatty acid and a polyalcohol.

3. A fuel according to claim 1 wherein said non-ionic emulsifier is an oxyethylation product of an alcohol with 8 to 22 carbon atoms or of an alkyl 1,2-glycol, of a fatty acid, fatty acid amine, fatty amine, synthetic fatty acid, resin acid or naphthenic acid or of an alkylphenol or of an aralkylphenol with 1 to 30 mols of ethylene oxide and/or propylene oxide or of esterification products of fatty acids and glycerol or of a polyalcohol.

4. A fuel according to claim 1 wherein said non-ionic emulsifier has been purified to remove salt constituents and polyalkylene glycol ether constituents therefrom by dissolving said non-ionic emulsifier in an organic water-immiscible solvent and treating the solution with water, removing the resultant aqueous layer therefrom to leave behind said emulsifier in said organic solvent and removing said organic solvent.

5. In a process for forming a fuel comprising a hydrocarbon, water and a non-ionic emulsifier wherein said hydrocarbon, water and non-ionic emulsifier are comixed the improvement wherein said non-ionic emulsifier is one which contains less than 1,000 ppm of salt constituents and less than 1 percent by weight of polyalkylene glycol ether constituents.

6. A fuel according to claim 1, wherein said fuel is a fuel for a combustion engine.

* * * * *